US006955570B2

(12) United States Patent
Mills et al.

(10) Patent No.: US 6,955,570 B2
(45) Date of Patent: Oct. 18, 2005

(54) SEMI-PERMANENT CONNECTION BETWEEN A BUS BAR AND A CONNECTOR CONTACT

(75) Inventors: James Mills, Quebec (CA); Miguel Conde, Seal Beach, CA (US); Patrick St-Louis, Boisbriand (CA)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/822,907

(22) Filed: Apr. 12, 2004

(65) Prior Publication Data

US 2004/0192097 A1 Sep. 30, 2004

Related U.S. Application Data

(63) Continuation of application No. 10/285,834, filed on Nov. 1, 2002, now Pat. No. 6,773,314.

(30) Foreign Application Priority Data

Nov. 20, 2001 (CA) ..... 2363530

(51) Int. Cl.[7] ..... H01R 11/22
(52) U.S. Cl. ..... 439/850; 439/857
(58) Field of Search ..... 439/850, 857, 439/687, 833, 839, 822, 851, 825, 827, 517, 846; 363/146, 666

(56) References Cited

U.S. PATENT DOCUMENTS

| | | | | | |
|---|---|---|---|---|---|
| 1,589,066 | A | * | 6/1926 | Gibbons | 200/275 |
| 2,704,838 | A | * | 3/1955 | Macha et al. | 439/822 |
| 3,193,791 | A | | 7/1965 | Bock et al. | 339/176 |
| 3,760,340 | A | * | 9/1973 | Friend | 439/847 |
| 3,914,008 | A | | 10/1975 | Hollander et al. | 339/259 R |
| 4,537,462 | A | | 8/1985 | Manabe | 439/833 |
| 4,583,812 | A | * | 4/1986 | Gross et al. | 439/839 |
| 4,776,817 | A | | 10/1988 | Jego et al. | 439/833 |
| 4,867,713 | A | | 9/1989 | Ozu et al. | 439/833 |
| 6,276,951 | B1 | | 8/2001 | Chen et al. | 439/327 |
| 6,293,831 | B1 | | 9/2001 | Yamatani | 439/850 |

FOREIGN PATENT DOCUMENTS

EP 0 814 551 A1 12/1997

* cited by examiner

*Primary Examiner*—Alex Gilman
(74) *Attorney, Agent, or Firm*—Harrington & Smith, LLP

(57) ABSTRACT

A connector for providing semi-permanent connection between a bus bar and a connector contact is formed by ovelapping a bus bar tab with at least one contact tail of the connector contact and gripping the overlapped bus bar tab and the contact tail with a spring clip. In this manner, the spring clip produces the pressure required to establish adequate contact between the bus bar tab and contact tail. According to another feature, the junction including the bus bar tab, the contact tail and the spring clip are isolated by covering them with an electrically insulating sleeve, this sleeve also serving to retain the spring clip in position.

13 Claims, 5 Drawing Sheets

SEMI-PERMANENT CONNECTION BETWEEN A BUS BAR AND A CONNECTOR CONTACT

CROSS REFERENCE TO RELATED APPLICATION

This is a continuation of U.S. patent application Ser. No. 10/285,834 filed Nov. 1, 2002, now U.S. Pat. No. 6,773,314.

FIELD OF THE INVENTION

The present invention relates to electrical connections. More specifically, but not exclusively, the present invention relates to a semi-permanent connection between a bus bar and a connector contact. The present invention is also concerned with a connector contact and a connector for semi-permanent connection to a bus bar.

BACKGROUND OF THE INVENTION

The use of bus bars to supply multiple loads from a single source of electric power is well known in the art and has found broad application in many power distribution settings. Examples of bus bars are found, amongst others, in automotive, industrial and residential installations.

Traditionally, soldered interconnections have been used in low voltage applications. However, with the increased modularization of components, solderless tab/socket combinations and associated cabling have been developed. Normally, the tab is inserted into the socket and selection of suitable shapes and materials is relied upon to insure that the contact pressure between the tab and the socket is sufficient to provide a good and durable electrical connection.

Alternatively, spring clips or leafs have been proposed to produce the necessary contact pressure. For example, U.S. Pat. No. 6,152,764 (Robinson et al.) issued on Nov. 28, 2000 discloses a watthour meter socket adapter which takes advantage of a spring clip to exert pressure on two contacting surfaces. Similarly, U.S. Pat. No. 6,178,106 B1 (Umemoto et al.) issued on Jan. 23, 2001 describes a power distribution centre including a spring clamp to urge a power terminal into contact with a bus bar.

SUMMARY OF THE INVENTION

In accordance with the present invention, there is provided a method of forming a semi-permanent connection between a substantially flat tab of a bus bar and a connector contact having first and second substantially flat, parallel and mutually facing contact tails, comprising inserting the flat bus bar tab between the first and second contact tails to form a sandwich structure, and spring clipping the sandwich structure whereby the flat bus bar tab is applied to both the first and second contact tails to thereby form the semi-permanent connection.

Preferably:

inserting the flat bus bar tab between the first and second contact tails comprises axially aligning the flat bus bar tab with the first and second contact tails;

covering the axially aligned bus bar tab and contact tails with an electrically insulating sleeve; and the method further comprises at least partially covering the spring clipped sandwich structure with an electrically insulating housing.

The present invention further relates to a connector contact for semi-permanent connection to a generally flat tab of a bus bar, comprising:

at least one contact member for connection to an external electric conductor;

at least one generally flat contact tail electrically connected to the contact member and destined to overlap the bus bar tab; and at least one U-shaped spring clip having a pair of claws defining a gripping region in which the bus bar tab and contact tail fit in overlapped position to form the semi-permanent connection between the bus bar tab and the contact tail.

According to preferred embodiments of the connector contact:

the generally flat contact tail is axial to the bus bar tab;

the generally flat contact tail is perpendicular to the bus bar tab;

the connector contact comprises first and second U-shaped spring clips for mounting on opposite sides of the overlapped bus bar tab and contact tail;

the connector contact comprises first and second generally flat, parallel and mutually facing contact tails defining between them a spacing to fit the bus bar tab and thereby form with the bus bar tab a sandwich structure that fits in the gripping region defined between the pair of claws of the U-shaped spring clip;

the first contact tail comprises first and second opposite lateral edges, and first and second transversal slots opening in the first and second opposite lateral edges, respectively;

the second contact tail comprises third and fourth opposite lateral edges, and third and fourth transversal slots opening in the third and fourth opposite lateral edges, respectively;

the first U-shaped spring clip is mounted over the first and third lateral edges, and the second U-shaped spring clip is mounted over the second and fourth lateral edges;

the first U-shaped spring clip comprises a first transversal stabilising leaf for insertion in the first and third transversal slots in view of preventing axial movement of the first U-shaped spring clip on the first and second contact tails;

the second U-shaped spring clip comprises a second transversal stabilising leaf for insertion in the second and fourth transversal slots in view of preventing axial movement of the second U-shaped spring clip on the first and second contact tails; and the connector contact comprises first and second generally flat, parallel and mutually facing contact members defining between them a spacing to fit the external electric conductor, the first contact member and the first contact tail are mechanically interconnected through a first bridge member, the second contact member and the second contact tail are mechanically and electrically interconnected through a second bridge member, and the first contact member and first contact tail are mechanically and electrically connected to the second contact member and second contact tail through a third bridge member Further in accordance with the present invention, there is provided a connector for semi-permanent connection to a generally flat tab of a bus bar, comprising at least one contact member for connection to an external electric conductor, at least one generally flat contact tail electrically connected to the contact member and destined to overlap the bus bar tab, at least one U-shaped spring clip having a pair of claws defining a gripping region in which the bus bar tab and contact tail fit in overlapped position to form the semi-permanent connection between the bus bar tab and the contact tail, and an electrically insulating housing for covering the contact tail and U-shaped spring clip.

According to a preferred embodiment of the connector:

the connector comprises two U-shaped spring clips for mounting on opposite sides of the overlapped bus bar tab and contact tail;

the electrically insulating housing comprises an electrically insulating sleeve for covering the contact tail, the bus bar tab and the spring clips;

the bus bar is flat, and the sleeve comprises a proximal end with diametrically opposite slots for receiving the bus bar; and the slots have respective closed ends, and the first and second spring clips comprise respective barbs for resting against the closed ends of the slots.

In accordance with another preferred embodiment of the connector:

the electrically insulating housing comprises an axial cavity in which said at least one contact member, said at least one contact tail, the bus bar tab and said at least one U-shaped spring clip are lying;

the cavity of the housing comprises a pair of opposite axial guiding ridges, said at least one U-shaped spring clip comprises two claws having respective slots, and the ridges are respectively lying in the slots of the claws; and the bus bar tab extends in a direction perpendicular to the axial cavity of the electrically insulating housing.

The present invention is still further concerned with a connection assembly comprising a generally flat tab of a bus bar, a connector contact comprising at least one generally flat contact tail overlapping the bus bar tab, and at least one U-shaped spring clip having a pair of claws defining a gripping region in which the ovelapped bus bar tab and contact tail are fitted to form a semi-permanent connection between the bus bar tab and the contact tail.

Advantageously, the connection assembly further comprises an electrically insulating housing covering the contact tail and U-shaped spring clip.

The foregoing and other objects, advantages and features of the present invention will become more apparent upon reading of the following non restrictive description of preferred embodiments thereof, given for the purpose of illustration only with reference to the accompanying drawings.

DETAILED DESCRIPTION OF THE PREFERRED EMBODIMENTS

Figure 1:
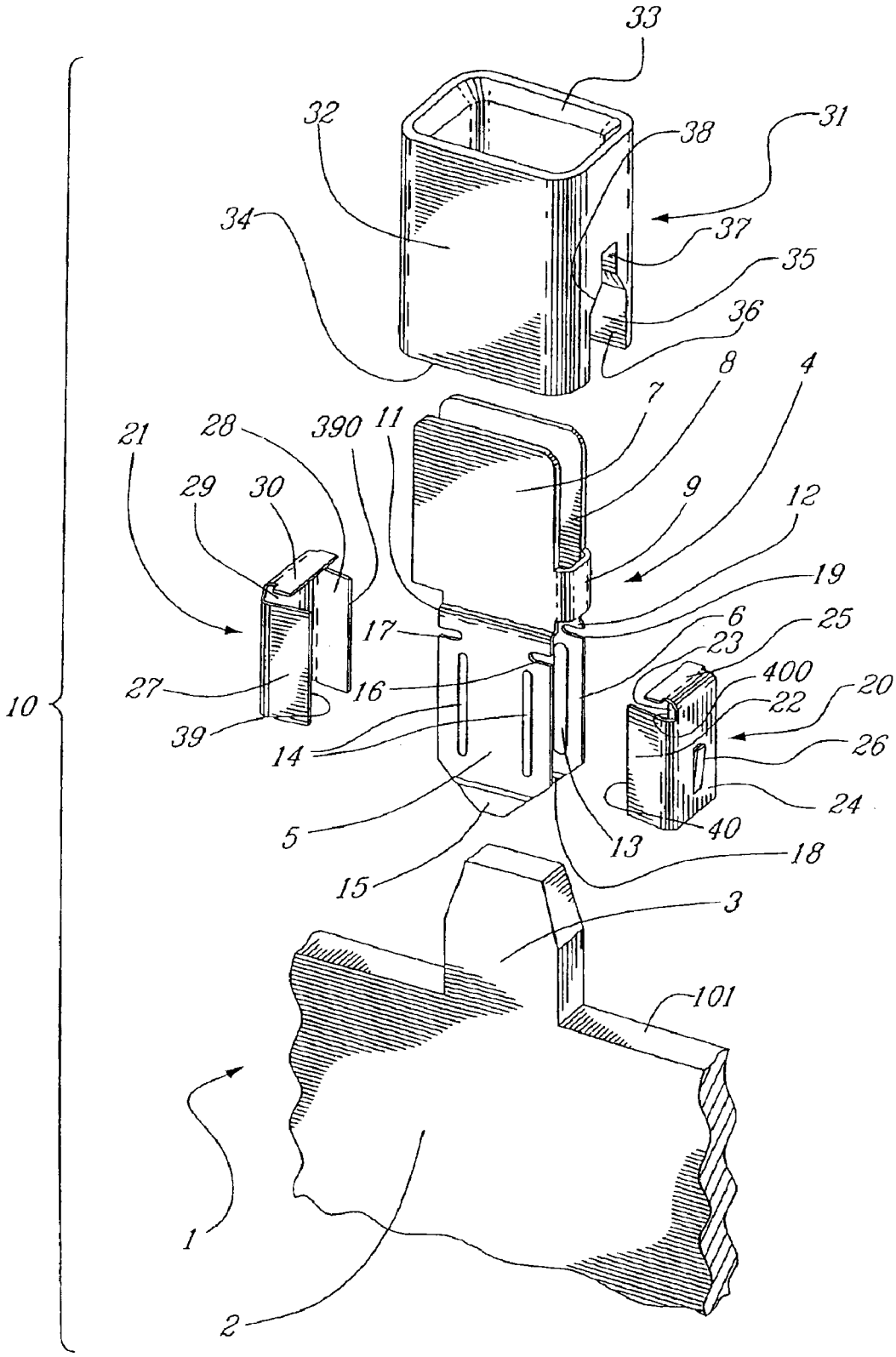
FIG. 1 is an exploded perspective view of a first preferred embodiment of connection assembly in accordance with the present invention.

The components of the first preferred embodiment of connection assembly in accordance with the present invention will now be described with reference to FIG. 1 of the appended drawings. In FIG. 1, the first preferred embodiment of connection assembly is generally identified by the reference 10.

Bus bar 1 is fabricated from a sheet 2 of electrically conductive material, for example sheet metal such as copper and aluminium. Bus bar 1 is connected to a power supply or other source of electric power (neither shown). The bus bar 1 is formed with at least one, usually a plurality of tabs such as 3 integral with the sheet 2 of electrically conductive material. In the preferred embodiment of FIG. 1, tab 3 is flat and coplanar with electrically conductive sheet 2. As illustrated, tab 3 protrudes from edge 101 of the bus bar 1.

The connection assembly 10 comprises a connector contact 4. As a non limitative example, this connector contact 4 is made of a single piece of electrically conductive sheet metal, such as copper and aluminium, cut and shaped as required.

The connector contact 4 comprises a pair of generally flat and parallel contact tails 5 and 6 defining mutually facing contact faces and a pair of generally flat and parallel contact members 7 and 8 defining mutually facing contact faces. As illustrated, the contact members 7 and 8 are generally parallel to the contact tails 5 and 6. Also, as illustrated in FIG. 1, the spacing between the generally parallel contact members 7 and 8 is smaller than the spacing between the generally parallel contact tails 5 and 6. However, it is within the scope of the present invention to provide contact members 7 and 8 with a spacing between them which is equal to or larger than the spacing between the parallel contact tails 5 and 6.

A transverse, curved bridge member 9 electrically and mechanically interconnects the contact members 7 and 8. Contact member 7 and contact tail 5 are electrically and mechanically interconnected through a suitably curved bridge member 11. Similarly, contact member 8 and contact tail 6 are electrically and mechanically interconnected through a suitably curved bridge member 12.

The contact tails 5 and 6 are equipped with a pair of parallel axial bosses (see axial bosses such as 13 in FIG. 1) on the inner face of these contact tails 5 and 6. These bosses 13 are designed to concentrate the contact force on given regions of the interfaces between these contact tails 5 and 6 and the bus bar tab 3. On the side of the contact tails 5 and 6 opposite to the axial bosses 13, these bosses 13 define a pair of parallel axial grooves 14 on both the outer faces of the contact tails 5 and 6.

Contact tail 5 has a free end formed with an outwardly deviating triangular flat end member 15. Tail 5 is further provided with a pair of opposite and transversal slots 16 and 17 opening in the opposite lateral edges of the contact tail 5 in the proximity of the bridge member 11.

In the same manner, contact tail 6 has a free end formed with an outwardly deviating triangular flat end member 18. Tail 6 is further provided with a pair of opposite and transversal slots (only slot 19 being shown in FIG. 1) opening in the opposite lateral edges of the contact tail 5 in the proximity of the bridge member 12.

Those of ordinary skill in the art will appreciate that the outwardly deviating triangular end members 15 and 18 ease insertion of the bus bar tab 3 between the contact tails 5 and 6. Of course, the spacing between the contact tails 5 and 6 is adjusted to snugly fit the tab 3 of the bus bar 1 between them. Also, the width and length of the contact tails 5 and 6 are preferably adjusted to completely cover the tab 3.

The connector 10 also comprises spring clips 20 and 21. As a non-limitative example spring clips 20 and 21 are made of a single piece of material cut and shaped as required. Spring clip 20 is preferably of U-shaped cross section and comprises first 22 and second 23 spring claws interconnected by a back plate 24. A transversal stabilising leaf 25 is connected to one edge of the back plate 24 between the spring claws 22 and 23. Additionally, an outwardly raising barb 26 pointing toward leaf 25 is formed into the back plate 24.

In a similar fashion to spring clip 20, spring clip 21 is preferably of U-shaped cross section and comprises first 27 and second 28 spring claws interconnected by a back plate 29. A transversal stabilising leaf 30 is connected to one edge of the back plate 29 between the spring claws 27 and 28. Additionally, an outwardly raising barb (not shown) pointing toward leaf 30 is also formed into the back plate 29.

The connection assembly 10 additionally comprises a sleeve 31. In a preferred embodiment, sleeve 31 is made from a flexible non-conductive material, for example plastic material. Sleeve 31 comprises a hollow sleeve body 32 having a substantially rectangular internal cross section, an open distal sleeve end 33 and an open proximal sleeve end 34. It will appear to those of ordinary skill in the art that the internal dimensions of the sleeve 31 are adjusted to fit the connector contact 4 and spring clips 20 and 21 snugly inside this sleeve 31 when the connection assembly 10 is fully assembled.

A pair of opposite slots such as 35 axially bisect the open proximal sleeve end 34 in the walls of smaller width of the sleeve 31. The open slot end 36 is dimensioned such that, on assembly of the connection assembly 10, sheet 2 fits snugly therein. The closed slot end 37 is of narrower dimension than sheet 2 and is connected to the open slot end 36 by an angled slot portion 38.

Figure 2:
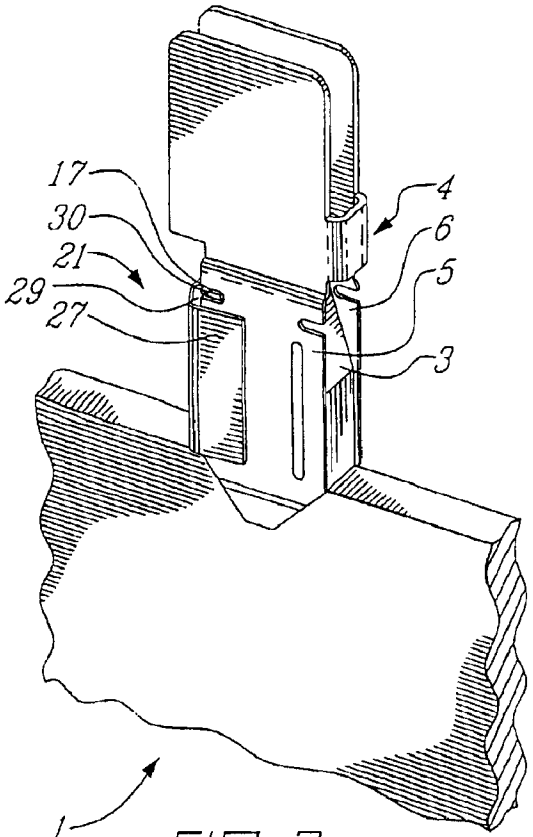
FIG. 2 is a perspective view of the connection assembly of FIG. 1, with one spring clip attached.

Referring now to FIG. 2 in addition to FIG. 1, a partially assembled version of the connection assembly 10 in accordance with the present invention will now be described. In FIG. 2, bus bar tab 3 is inserted between parallel contact tails 5 and 6.

Spring clip 21 is installed on the connector contact 4. The first spring claw 27 and the second spring claw 28 slightly taper inwardly relative to one another as they move away from the back plate 29 such that the forward edge 39 of the first spring claw 27 and the forward edge 390 of the second spring claw 28 apply pressure on the sandwich structure formed by the contact tails 5 and 6 and the bus bar tab 3. This pressure not only establishes a suitable electrical contact between the contact tails 5 and 6 and the bus bar tab 8 but also restricts outward motion of the spring clip 21 and resists to removal of this spring clip 21 from the assembly 10. Additionally, the stabilising spring leaf 30 is inserted in the corresponding transversal slots (including slot 17) to thereby restrict axial motion of spring clip 21.

Figure 3:
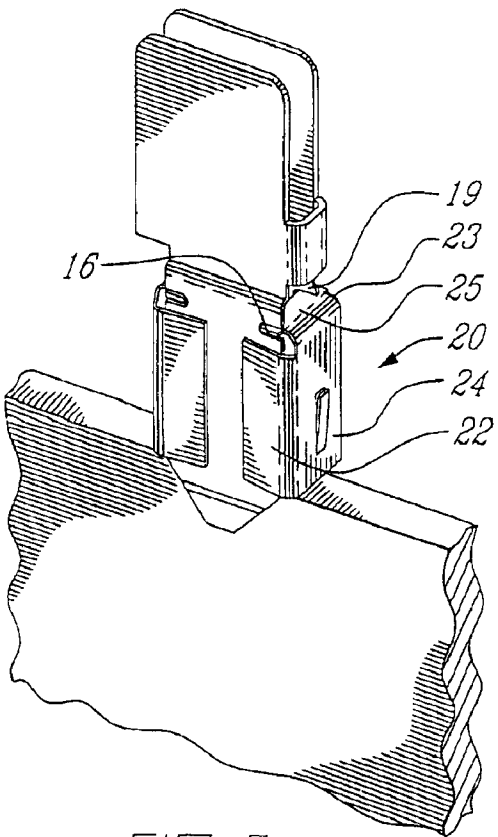
FIG. 3 is a perspective view of the connection assembly of FIGS. 1 and 2, with two spring clips attached.

Referring now to FIG. 3 in addition to FIGS. 1 and 2, spring clip 20 is positioned on the connector contact 4. Similar to spring clip 21, the first spring claw 22 and the second spring claw 23 of spring clip 20 slightly taper inwardly relative to one another as they move away from the back plate 24 such that the forward edge 40 of spring claw 22 and the forward edge 400 (FIG. 1) of spring claw 23 apply pressure on the sandwich structure formed of the contact tails 5 and 6 and the bus bar tab 3. This pressure not only establishes a suitable electrical contact between the contact tails 5 and 6 and the bus bar tab 8 but also restricts outward motion of the spring clip 20 and resists to removal of this spring clip 20 from the assembly 10. Additionally, the stabilising leaf 25 is inserted in transversal slots 16 and 19 thereby restricting axial motion of spring clip 20.

Figure 4:
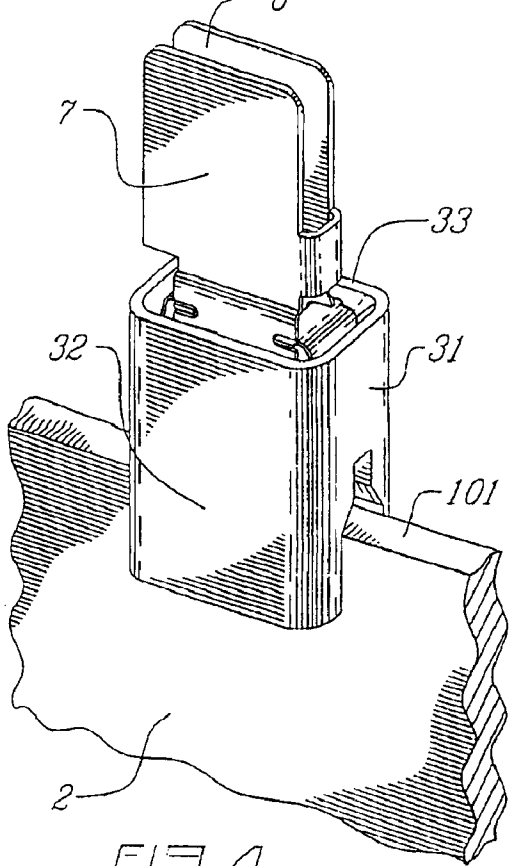
FIG. 4 is a perspective view of the fully assembled connection assembly of FIGS. 1–3.

Referring now to FIG. 4 in addition to FIGS. 1, 2 and 3, the non-conductive sleeve 31 has been positioned over the structure of FIG. 3 such that the sleeve body 32 completely covers the bus bar tab 3 and contact tails 5 and 6. In FIG. 4, spring clips 20 and 21 are also enclosed and held in place by the sleeve body 32. Contact members 7 and 8 protrude from the open distal sleeve end 33. Sheet 2 is partially covered by that portion of the sleeve body 32 which is coincident with the pair of opposite slot portions 36. The edge 101 of sheet 2 is inserted in the pair of opposite slot portions 36 until it rest on the angled slot portions 38. This position is concomitant with the bus bar tab 3 being located substantially between the contact tails 5 and 6.

Once the sleeve 31 is installed as depicted in FIG. 4, barb 26 of spring clip 20 and the barb (not shown) of spring clip 21 rests on the bottom of the respective closed slot ends 37 of the opposite slots 35. These barbs limit the course of the sleeve 31 toward sheet 2.

Just a word to mention that, in the various embodiments, the clips such as 20 and 21 are advantageously non-current carrying external clips providing the spring force for the contact to occur between the mated surfaces.

Also, those of ordinary skill in the art will appreciate that the various embodiments of connection assembly according to the invention form, without the bus bar tab, a connector capable of being semi-permanently connected to a bus bar tab.

Another possible method of installing connection assembly 10 on the bus bar tab 3 comprises placing spring clip 20 on the contact tails 5 and 6, placing spring clip 21 on the contact tails 5 and 6, placing the sleeve 31 over the structure formed of the contact tails 5 and 6 and spring clips 20 and 21 until the barbs such as 26 rest on the bottom of the closed slot ends 37, and sliding the bus bar tab 3 between the contact tails 5 and 6 of the so formed connector to obtain the connection assembly of FIG. 4. The portion of the sleeve body 32 coincident with the pair of opposite slots 35 is able to deflect marginally outward to ease insertion of the bus bar tab 3 between the contact tails 5 and 6.

Figure 5:
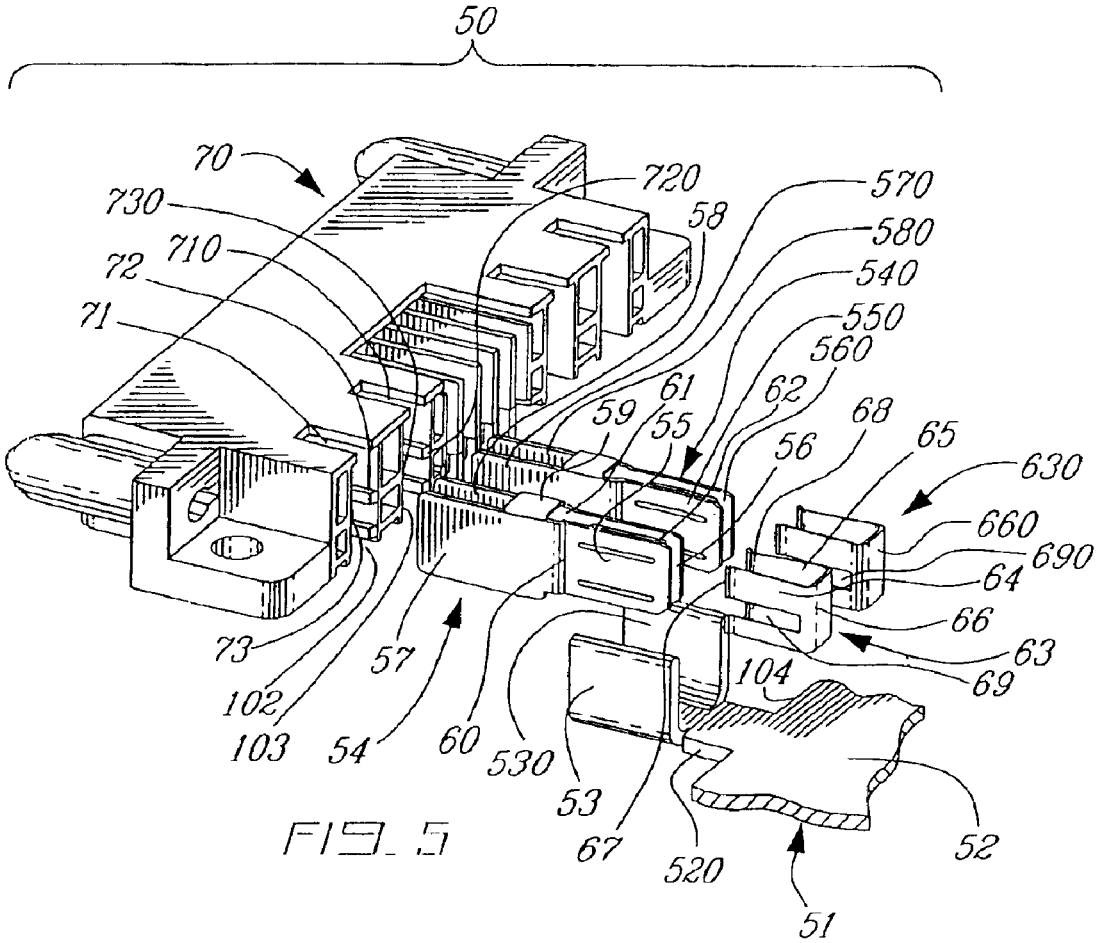
FIG. 5 is an exploded perspective view of a second preferred embodiment of connection assembly in accordance with the present invention.

Referring now to FIG. 5 an alternative preferred embodiment of the connection assembly in accordance with the present invention is disclosed. In FIG. 5, this alternative preferred embodiment of the connection assembly is generally identified by the reference 50.

A bus bar 51 is fabricated from a sheet 52 of electrically conductive material, for example sheet metal such as copper and aluminium. Bus bar 51 is connected to a power supply or other source of electric power (neither shown). The bus bar 51 is formed with at least one, usually a plurality of tabs such as 53 integral with the sheet 52 of electrically conductive material. In the preferred embodiment of FIG. 5, tab 53 is flat and perpendicular to the electrically conductive sheet 52. In the illustrated preferred embodiment, a T-shaped flat portion 520 is cut from the sheet 52. This T-shaped flat portion 520 has two opposite free ends bent parallel to each other to form tabs 53 and 530.

The connection assembly 50 comprises a connector contact 54. As a non limitative example, this connector contact 54 is made of a single piece of electrically conductive sheet metal, such as copper or aluminium, cut and shaped as required.

The connector contact 54 comprises a pair of generally flat and parallel contact tails 55 and 56 defining mutually facing contact faces and a pair of generally flat and parallel contact members 57 and 58 also defining mutually facing contact faces. As illustrated, the contact members 57 and 58 are generally parallel to the contact tails 55 and 56. Also, as illustrated in FIG. 5, the spacing between the generally parallel contact members 57 and 58 is larger than the spacing between the generally parallel contact tails 55 and 56. However, it is within the scope of the present invention to provide contact members 57 and 58 with a spacing between them which is equal to or smaller than the spacing between the parallel contact tails 55 and 56.

A transverse, curved bridge member 59 electrically and mechanically interconnects the contact members 57 and 58. Contact member 57 and contact tail 55 are electrically and mechanically interconnected through a suitably curved bridge member 60. Similarly, contact member 58 and contact tail 56 are electrically and mechanically interconnected through a suitably curved bridge member 61.

The contact tails 55 and 56 are equipped with a pair of parallel axial bosses (see axial bosses such as 62 in FIG. 5) on the inner face of these contact tails 55 and 56. These bosses 62 are designed to concentrate the contact force on given regions of the interfaces between these contact tails 55 and 56 and the bus bar tab 53.

The connection assembly 50 also comprises a spring clip 63. As a non limitative example spring clip 63 is made from a single piece of material cut and shaped as required. Spring clip 63 is preferably of U-shaped cross section and comprises a first spring claw 64 and a second spring claw 65 joined together by a back plate 66. The forward edge 67 of the first spring claw 64 and the forward edge 68 of the second spring claw 65 are curved outwards. A pair of opposite slots such as 69 respectively extend at right angle from the forward edge 67 of the first spring claw 64 and the forward edge 68 of the second spring claw 65 to a short distance from the back plate 66. As illustrated, the slots 69 bisect the first 64 and second 65 spring claws, respectively.

The connection assembly 50 also comprises a modular multi-contact housing 70 made of electrically insulating material such as molded plastic material. As a non limitative example, the modular multi-contact housing 70 comprises a plurality of open-ended axial cavities such as 71 each provided with a pair of opposite lateral inner guiding ridges 72 and 73.

In assembly, the connector contact 54 is axially lying in one of the cavities 71 of the housing 70. As well known to those of ordinary skill in the art and although this is not illustrated in the appended drawings; cavity 71 can be easily designed to retain the connector contact 54 in axial position in the cavity 71. Bus bar tab 53 is sandwiched between the contact tails 55 and 56 perpendicular to these contact tails 55 and 56; housing 70 is open sideways (see 102) at the level of cavity 71 to enable passage of the tab 53 toward the inside of that cavity 71. Spring clip 63 is mounted over the contact tails 55 and 56 with the back plate 66 over the free ends of the tails 55 and 56. Also, the opposite guiding ridges 72 and 73 are respectively lying in the opposite slots such as 69 of the spring clip 63. The bus bar tab 53 is thereby grasped between the contact tails 55 and 56 to establish the required contact pressure. Then, a suitable contact can be inserted through the front open end of axial cavity 71 for connection to the contact members 57 and 58 of the connector contact 54.

Simultaneously, another connector contact 540 (identical to connector contact 54) and spring clip 630 (identical to spring clip 63) are associated to an open-ended axial cavity 710 (identical to cavity 71). Again, bus bar tab 530 is sandwiched between the contact tails 550 and 560 of connector contact 540 perpendicular to these contact tails 550 and 560; housing 70 is open sideways at the level of cavity 710 (see 103) to enable passage of the tab 530 toward the inside of the cavity 710. Spring clip 630 is mounted over the contact tails 550 and 560 with the back plate 660 over the free ends of the tails 550 and 560. Also, the opposite guiding ridges 720 and 730 are respectively lying in the opposite slots such as 690 of the spring clip 630. The bus bar tab 530 is thereby grasped between the contact tails 550 and 560. Then, a suitable contact can be inserted through the front open end of axial cavity 710 for connection to the contact members 570 and 580 of the connector contact 540.

Of course, it should be understood that many pairs of tabs such as 53 and 530 can be distributed along longitudinal edge 104 of the sheet 52 of bus bar 51.

Referring now to FIGS. 7, 8, 9 and 10 alternative embodiments of the connection assembly in accordance with the present invention are illustrated. In FIGS. 7, 8, 9 and 10 the alternative preferred embodiments of the connection assembly are generally identified by the reference 76.

Figures 7, 8, 9, 10:
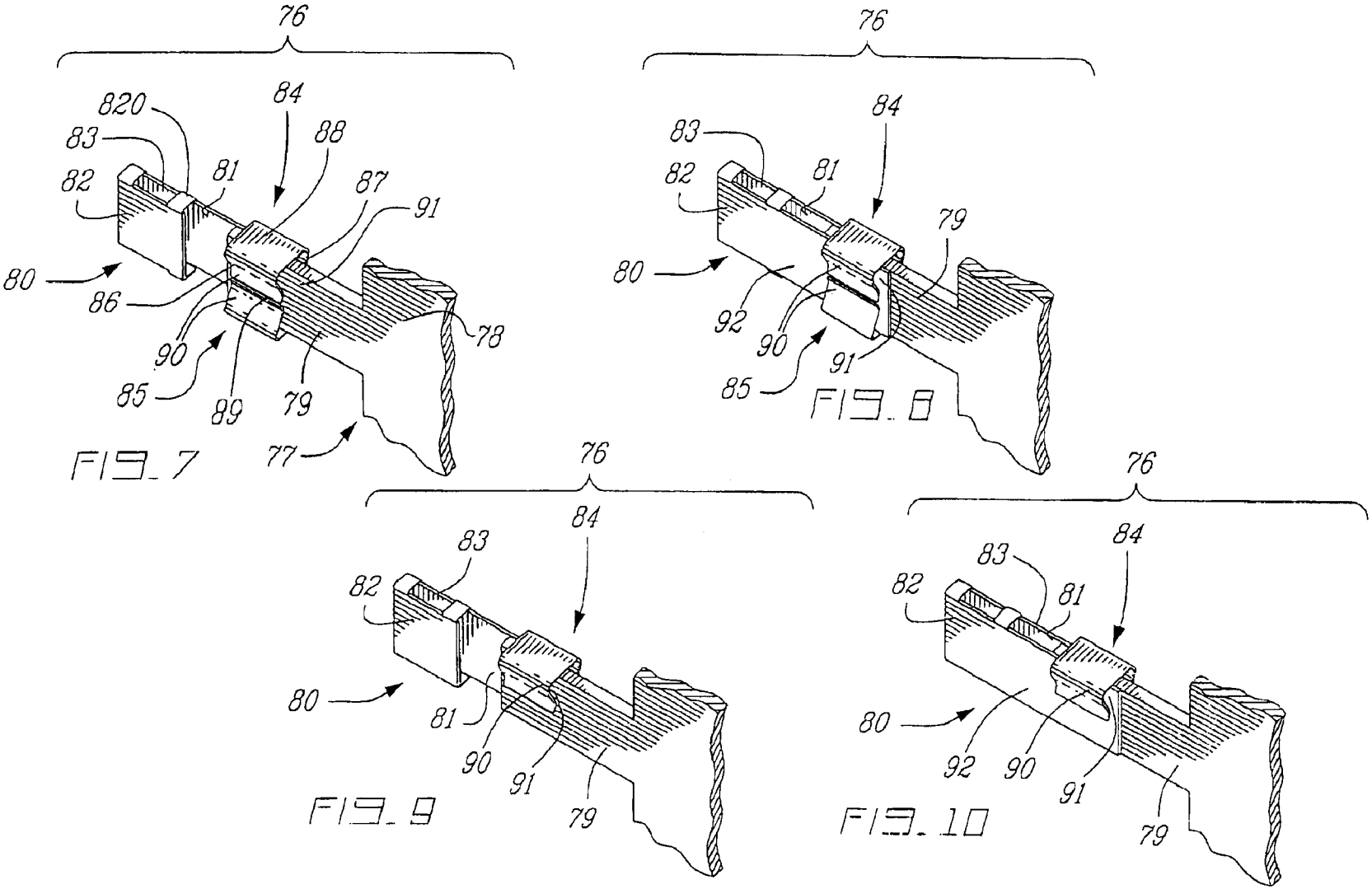
FIG. 7 is a perspective view of a third preferred embodiment of connection assembly in accordance with the present invention including one contact tail and two spring clips.
FIG. 8 is a perspective view of a fourth preferred embodiment of connection assembly according to the invention including two contact tails and two spring clips.
FIG. 9 is a perspective view of a fifth preferred embodiment of connection assembly in accordance with the present invention having one contact tail and one spring clip.
FIG. 10 is a perspective view of an alternative preferred embodiment of connection assembly according to the invention comprising two contact tails and one spring clip.

Referring to FIG. 7, a bus bar 77 is fabricated from a sheet 78 of electrically conductive material, for example sheet metal such as copper and aluminium. Bus bar 77 is connected to a power supply or other source of electric power (neither shown). Bus bar 77 is formed with at least one, usually a plurality of tabs such as 79 integral with the sheet 78 of electrically conductive material. Tab 79 is flat and coplanar with the electrically conductive sheet 78.

The connection assembly 76 comprises a connector contact 80. As a non limitative example, this connector contact 80 is made of a single piece of electrically conductive sheet metal cut and shaped as required.

More specifically, connector contact 80 comprises a generally flat contact tail 81 and a pair of generally flat and parallel contact members 82 and 83. As illustrated, the contact members 82 and 83 are spaced apart from each other, and are generally parallel to each other and to the contact tail 81. Also, as illustrated in FIG. 7, the contact members 82 and 83 are interconnected through four bridging members such as 820. The spacing between the generally parallel contact members 82 and 83 is selected to receive and accommodate an external contact to be connected to the bus bar 77.

The connection assembly 76 also comprises a pair of spring clips 84 and 85. Since each spring clip 84 and 85 is constructed similarly, only one such spring clip will be described for purposes of brevity. As a non limitative example, spring clip 84 is made from a single piece of material cut and shaped as required. Spring clip 84 is preferably of U-shaped cross section and comprises a first spring claw 86 and a second spring claw 87 joined together by a back plate 88. A pair of opposite ridges as in 90 are crimped in the first spring claw 86 and second spring claw 87. First spring claw 86 and second spring claw 87 converge towards one another such that the spacing between the pair of opposite ridges 90 is less than the breadth of the back plate 88 thereby forming a gripping region 91 therebetween. The crimping also serves to deflect the first spring claw forward edge 89 and the second spring claw forward edge (not shown) outwards, thereby facilitating insertion of the overlapped bus bar tab 79 and contact tail 81 between them.

When the connection assembly 76 is completed, the contact tail 81 overlaps the bus bar tab 79, and the tab 79 is in alignment with the tail 81. Spring clips 84 and 85 are mounted over the ovelapped bus bar tab 79 and contact tail 81 such that the bus bar tab 79 and contact tail 81 are pressed together by the gripping regions 91 located between the opposite ridges 90 of the spring clips 84 and 85. This ensures adequate electrical and mechanical contact between the bus bar tab 79 and the contact tail 81.

Finally, the connector contact 80 along with the spring clips 84 and 85 can be mounted in one cavity of a housing (not shown), made of electrically insulating material such as plastic.

Referring now to FIG. 8, connector contact 80 comprises a generally flat contact tail 92 in addition to the generally flat contact tail 81 and the pair of generally flat and parallel contact members 82 and 83.

When the connection assembly 76 is completed, the bus bar tab 79 is inserted between the contact tails 81 and 92 in alignment with these contact tails. The spacing between the contact tails 81 and 92 is designed to snugly fit the bus bar tab 79. The spring clips 84 and 85 are mounted over the sandwiched bus bar tab 79 and contact tails 81 and 92 in the same manner as described in relation to FIG. 7. Finally, the connector contact 80 along with the spring clips 84 and 85 can be mounted in one cavity of a housing (not shown), made of electrically insulating material such as plastic.

Referring now to FIG. 9, connector contact 80 comprises the generally flat contact tail 81, the pair of generally flat and parallel contact members 82 and 83 and a single spring clip 84.

When the connection assembly 76 is completed, the bus bar tab 79 overlaps with and is in alignment with contact tail 81. The overlapped bus bar tab 79 and contact tail 81 are inserted into the gripping region 91 located between the opposite ridges 90 of spring clip 84. Again, the connector contact 80 along with the spring clip 84 can be mounted in one cavity of an electrically insulating housing (not shown).

Referring now to FIG. 10, the connector contact 80 comprises the generally flat contact tails 81 and 92, the pair of generally flat and parallel contact members 82 and 83, and a single spring clip 84.

When assembled, the bus bar tab 79 is inserted between the contact tails 81 and 92 in alignment with these contact tails. The spacing between the contact tails 81 and 92 is designed to snugly fit the bus bar tab 79. The spring clip 84 is placed over the sandwiched bus bar tab 79 and contact tails 81 and 92 in the same manner as described with reference to FIG. 8. The connector contact 80 along with the spring clip 84 can be mounted in one cavity of an electrically insulating housing (not shown).

Referring now to FIGS. 11, 12, 13 and 14, further alternative embodiments of the connection assembly in accordance with the present invention are illustrated. In FIGS. 11, 12, 13 and 14 the alternative preferred embodiments of the connection assembly are generally identified by the reference 93. Since the elements of the connection assembly 93 are the same as described in relation to the embodiments of FIGS. 7, 8, 9 and 10, these elements will be identified by the same references. Of course, these elements have already been fully described in the foregoing description.

Figure 11:
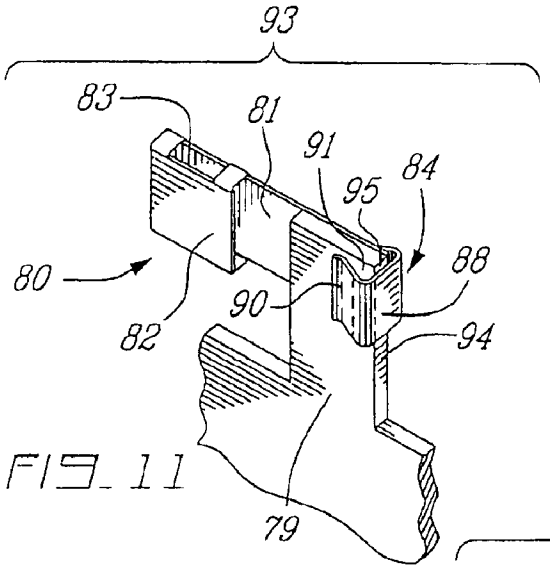
FIG. 11 is a perspective view of a seventh preferred embodiment of connection assembly in accordance with the present invention incorporating one contact tail and one spring clip.

Referring to FIG. 11, the connector contact 80 comprises the generally flat contact tail 81, the pair of generally flat and parallel contact members 82 and 83 and the spring clip 84.

As illustrated in FIG. 11, the bus bar tab 79 is lying at right angle to the connector contact 80 and is overlapping with contact tail 81. Spring clip 84 is mounted over the overlapped bus bar tab 79 and contact tail 81 with the back plate 88 abutting against a bus bar tab side 94 and a contact tail end 95. Also, the overlapped bus bar tab 79 and contact tail 81 are situated within the gripping region 91 between the opposite ridges 90 of spring clip 84.

Figure 12:
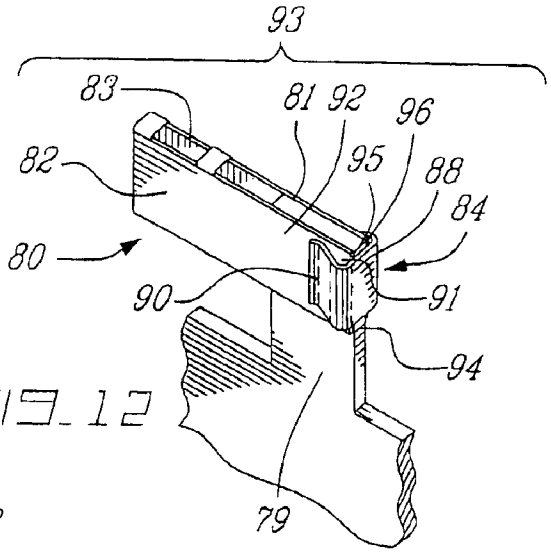
FIG. 12 is a perspective view of a further preferred embodiment of connection assembly in accordance with the present invention having two contact tails and one spring clip.

Referring now to FIG. 12, the connector contact 80 comprises the generally flat contact tails 81 and 92, the pair of generally flat and parallel contact members 82 and 83 and spring clip 84.

Still referring to FIG. 12, bus bar tab 79 is lying at right angle to the connector contact 80 and is inserted between the contact tails 81 and 92. Spring clip 84 is mounted over the sandwiched bus bar tab 79 and contact tail 81 and 92 with the back plate 88 abutting against bus bar tab side 94 and contact tail ends 95 and 96. Therefore, the overlapped bus bar tab 79 and contact tails 81 and 92 are located within the gripping region 91 located between the opposite ridges 90 of spring clip 84.

Figure 13:
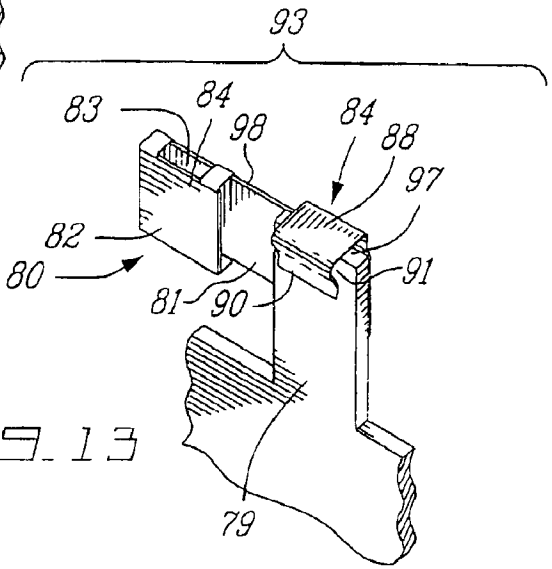
FIG. 13 is a perspective view of a ninth preferred embodiment of connection assembly in accordance with the present invention with one contact tail and one spring clip.

Referring to FIG. 13, the connector contact 80 comprises the generally flat contact tail 81, the pair of generally flat and parallel contact members 82 and 83 and spring clip 84.

Still referring to FIG. 13, the bus bar tab 79 is lying at right angle to the connector contact 80 and overlapped with contact tail 81 Spring clip 84 is mounted over the overlapped bus bar tab 79 and contact tail 81 with the back plate 88 abutting against a bus bar tab end 97 and a contact tail side 98. Then the bus bar tab 79 and contact tail 81 are within the gripping region 91 located between the opposite ridges 90 of spring clip 84.

Figure 14:
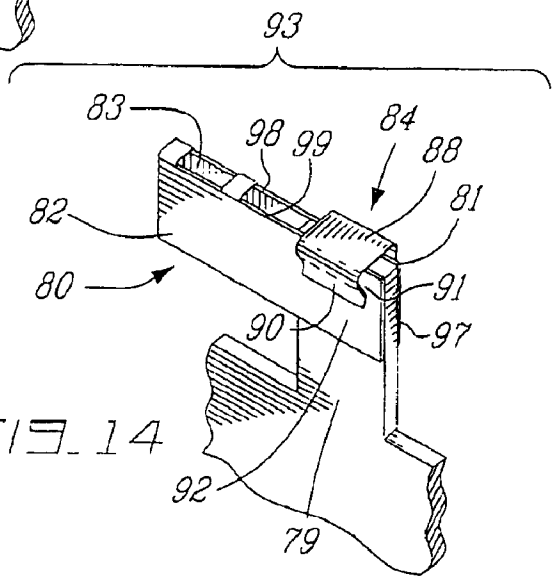
FIG. 14 is a perspective view of a last preferred embodiment of connection assembly in accordance with the present invention comprising two contact tails and one spring clip.

Referring now to FIG. 14, the connector contact 80 comprises the generally flat contact tails 81 and 92, the pair of generally flat and parallel contact members 82 and 83 and spring clip 84.

Still referring to the connection assembly 93 of FIG. 14, the bus bar tab 79 is lying at right angle to the connector contact 80 between the contact tails 81 and 92. Spring clip 84 is mounted over the sandwiched bus bar tab 79 and contact tails 81 and 92 with the back plate 88 abutting against bus bar tab end 97 and contact tail sides 98 and 99. Therefore, the bus bar tab 79 and contact tails 81 and 92 are within the gripping region 91 located between the opposite ridges 90 of spring clip 84.

It should be clear to those of ordinary skill in the art that the connector contact 80 and bus bar tab 79 could be fashioned such that the bus bar tab 79 could be aligned with the connector contact 80 at any given angle and therefore the invention is not limited to the embodiments disclosed above, i.e. aligned or at right angle to one another.

Figure 6:
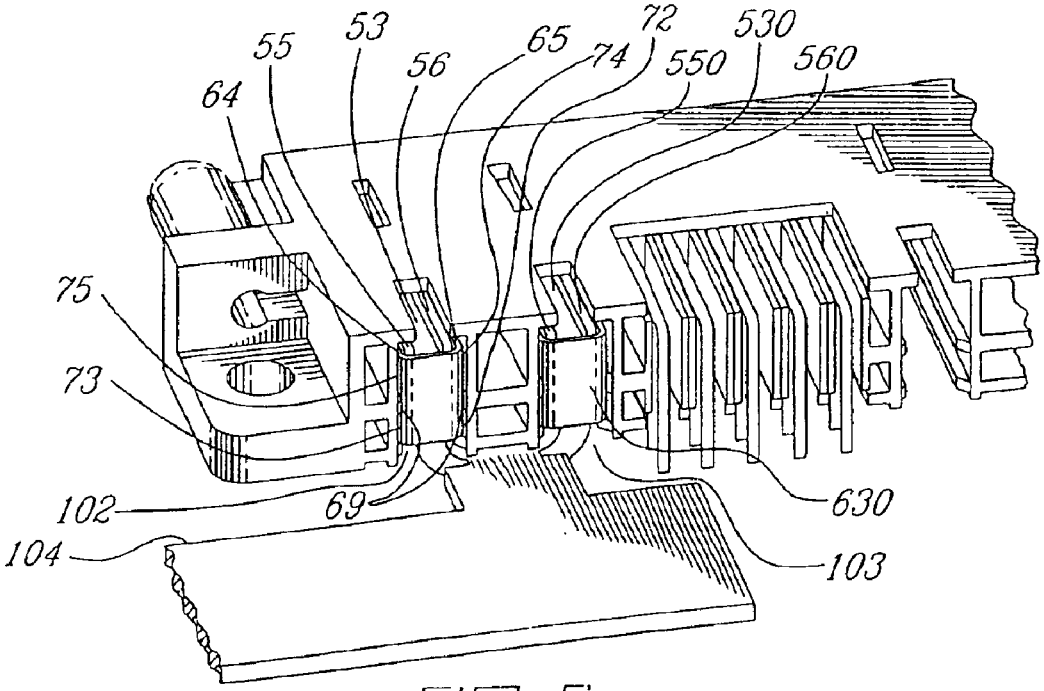
FIG. 6 is a perspective view of the fully assembled connection assembly of FIG. 5.

Also, the connection assembly 93 of FIGS. 11–14 can be provided with or mounted within:

an individual, electrically insulating envelope (not shown); or an electrically insulating housing such as 70 in FIGS. 5 and 6.

Although the present invention has been described hereinabove with reference to preferred embodiments thereof, it should be kept in mind that these preferred embodiments can be modified at will, within the scope of the appended claims, without departing from the spirit and nature of the invention.

The embodiment of the invention in which an exclusive property or privilege is claimed are defined as follows:

1. A method of forming a semi-permanent connection between a substantially flat tab of a bus bar and a connector contact having first and second substantially flat, parallel and mutually facing contact tails, comprising:

inserting the flat bus bar tab between the first and second contact tails to form a sandwich structure; and attaching a spring clip to the sandwich structure after the flat bus bar tab is inserted between the first and second contact tails, wherein the flat bus bar tab is applied to both the first and second contact tails to thereby form said semi-permanent connection.

2. The method of claim 1, further comprising at least partially covering the spring clipped sandwich structure with an electrically insulating housing.

3. The method of claim 1, wherein inserting the flat bus bar tab between the first and second contact tails comprises axially aligning said flat bus bar tab with said first and second contact tails.

4. The method of claim 3, further comprising covering the axially aligned bus bar tab and contact tails with an electrically insulating sleeve.

5. A connector for semi-permanent connection to a generally flat tab of a bus bar, comprising:

at least one contact member for connection to an external electric conductor;

at least one generally flat contact tail electrically connected to the contact member and destined to overlap the bus bar tab;

two U-shaped spring clips, each spring clip having a pair of claws defining a gripping region in which the bus bar tab and contact tail fit in overlapped position to form said semi-permanent connection between the bus bar tab and the contact tail, wherein the spring clips are located on opposite sides of the bus bar tab; and an electrically insulating housing for covering the contact tail and U-shaped spring clip, wherein the bus bar is flat, and wherein the electrically insulating housing comprises a proximal end with diametrically opposite slots for receiving portions of the bus bar.

6. A connector as recited in claim 5, wherein said at least one generally flat contact tail comprises first and second generally flat, parallel and mutually facing contact tails defining between them a spacing to fit the bus bar tab and thereby form with said bus bar tab a sandwich structure that fits in the gripping region defined between the pair of claws of each of the U-shaped spring clips.

7. A connector as recited in claim 5, wherein the electrically insulating housing comprises an axial cavity in which said at least one contact members said at least one contact tail, the bus bar tab and said two U-shaped spring clips are lying.

8. A connector as recited in claim 7, wherein the bus bar tab extends in a direction perpendicular to the axial cavity of the electrically insulating housing.

9. A connection assembly comprising:

generally flat tab of a bus bar;

a connector contact comprising at least one generally flat contact tail overlapping the bus bar tab; and at least one U-shaped spring clip having a pair of claws defining a gripping region in which the overlapped bus bar tab and contact tail are fitted to form a semi-permanent connection between the bus bar tab and the contact tail, wherein the at least one spring clip comprises an outwardly raised barb adapted to contact a housing mounted over the spring clip in a barb mounting slot of the housing.

10. The connection assembly of claim 9, further comprising an electrically insulating housing covering the contact tail and U-shaped spring clip.

11. The connection assembly of claim 9, wherein said at least one generally flat contact tail comprises first and second generally flat, parallel and mutually facing contact tails defining between them a spacing in which the bus bar tab is fitted to thereby form with said bus bar tab a sandwich structure inserted in the gripping region defined between the pair of claws of the U-shaped spring clip.

12. The connection assembly of claim 11, wherein said at least one U-shaped spring clip comprises two U-shaped spring clips mounted on opposite sides of the sandwich structure.

13. A connection assembly comprising:

a bus bar comprising a connection tab;

a connector contact comprising at least one contact tail overlapping the connection tab; and a plurality of U-shaped spring clips, each spring clip having claws defining a gripping region in which the connection tab and the at least one contact tail are fitted to form a semi-permanent connection therebetween, wherein at least two of the U-shaped spring clips are mounted on opposite sides of a sandwich structure formed by the connection tab and the at least one contact tail.

* * * * *